United States Patent [19]

Langham

[11] Patent Number: 4,467,870

[45] Date of Patent: Aug. 28, 1984

[54] FLUID PRESSURE ACTUATOR FOR SUBTERRANEAN WELL APPARATUS

[75] Inventor: Ronald F. Langham, Tulsa, Okla.

[73] Assignee: Baker Oil Tools, Inc., Orange, Calif.

[21] Appl. No.: 395,544

[22] Filed: Jul. 6, 1982

[51] Int. Cl.[3] ..... E21B 34/10

[52] U.S. Cl. ..... 166/321; 166/374

[58] Field of Search ..... 166/319–324, 166/373, 375; 251/61, 63.4

[56] References Cited

U.S. PATENT DOCUMENTS

| | | | |
|---|---|---|---|
| 2,731,977 | 1/1956 | McGowen, Jr. | 137/155 |
| 2,797,700 | 7/1957 | McGowen, Jr. | 137/155 |
| 3,310,114 | 3/1967 | Dollison | 166/321 X |
| 3,626,969 | 12/1971 | Garrett | 137/155 |
| 3,747,633 | 7/1973 | Garrett | 137/489.3 |
| 3,802,504 | 4/1974 | Garrett | 166/133 |
| 4,161,219 | 7/1979 | Pringle | 166/324 |

*Primary Examiner*—Ernest R. Purser
*Assistant Examiner*—Thuy M. Bui
*Attorney, Agent, or Firm*—Norvell & Associates

[57] ABSTRACT

A valve for use in controlling flow in a subterranean well and using an expandable and contractable fluid sealing bellows is disclosed. The valve has a valve closure member such as a ball valve head acutated by an increase in control fluid pressure. Control pressure causes the bellows to expand or contract and a control rod engaging the bellows can be shifted. The control rod is part of an actuating mechanism for shifting the valve closure member between open and closed positions. The bellows can support the difference between control pressure and well pressure which are respectively present on the exterior and interior of each bellows element.

16 Claims, 9 Drawing Figures

FLUID PRESSURE ACTUATOR FOR SUBTERRANEAN WELL APPARATUS

BACKGROUND OF THE INVENTION

1. Field of the Invention

This invention relates to valves used in subterranean oil or gas wells which are actuated by control fluid pressure.

2. Description of the Prior Art

Valves for controlling the flow of fluids in a subterranean oil and gas well are employed both at the surface of the well and often within the well itself. Perhaps the most common type of downhole valve is the surface control well safety valve. Conventionally these valves are actuated by an increase or decrease in the control fluid pressure in a separate control line extending from the valve to the surface of the well. Although there are numerous types of downhole safety valves the most common valves are ball valves and flapper type safety valves. Conventional ball type safety valves employ a rotatable spherical head or ball having a central flow passage which can be aligned with respect to the bore of the valve to permit flow through the valve and therefore in the fluid transmission conduit or tubing string. Rotation of the ball valve element through an angle of 90° will prevent flow through the central flow passage and will close the valve. Rotation of ball valve elements between open and closed positions is generally imparted by a combination of longitudinal and rotary movement of the valve. Conventionally a camming element or actuating mechanism is used to rotate the ball valve head during axial movement of the valve. Axial movement is generally imparted to the valve by increasing the control pressure acting in the control line and acting on a pressure movable member within the valve itself. As pressure is increased a sleeve or piston is generally moved in one axial direction which in turn will cause the valve to rotate from a closed to an open position permitting flow through the valve. A reduction in control pressure, which may be caused by a rupture in the control line or destruction of the wellhead, will permit the valve to automatically close.

Another common type of surface control well safety valve employs a flapper valve head. Rotation of the flapper about an axis transverse to the axis of the valve bore will open the valve bore. The conventional means of actuating the valve head is to employ an axially movable flow tube which abuts the downstream surface of the flapper head and causes the flapper head to rotate about its hinge to open the valve bore. Normally axial movement of the flow tube is caused by an increase in control fluid pressure acting on one surface of the flow tube or on one surface of a member interconnected with the flow tube. As with the ball type safety valve a reduction in control fluid pressure will permit axial movement of the flow tube in the opposite direction and will allow the flapper valve head to close the valve bore.

There are certain limitations on the performance of conventional ball type or flapper type safety valve. For example hostile environmental conditions such as temperatures in access of 500° or the presence of toxic liquids and gases can adversely affect the performance of elastomeric sealing elements used in conventional safety valves. There is also a limitation upon the depth at which conventional safety valves can be employed. The hydrostatic pressure of the control fluid in the external control pressure line must always be less than the actuating pressure necessary to open the safety valve. Thus positioning conventional safety valves at great depths would require the use of quite large springs to resist movement of the control actuating sleeves or pistons. One safety valve design which has been proposed as a means for overcoming the depth limitations placed upon conventional safety valve is a piston actuated safety valve disclosed in U.S. Pat. No. 4,161,219. This valve employs a separate piston located in the valve housing to actuate a cylindrical flow tube or sleeve which in turn is used to open a conventional flapper valve head. The cross-sectional area of the piston is less than the cross-sectional area of the flow tube thus resulting in a smaller hydrostatic pressure force tending to open a deep set safety valve. This valve still employs conventional elastomeric sealing elements on the piston member. Elastomeric sealing elements are not only adversely affected by hostile conditions in the well but are unsuitable for use with gases. Therefore liquids must be used as the control fluid, despite the fact that pressurized gas is often conveniently available at the well site. The elimination of elastomeric seals in the control pressure actuating system would permit the use of gas as a control fluid and would ease the environmental limitations on the use of safety valves.

SUMMARY OF THE INVENTION

This invention provides a valve, especially a downhole safety valve, for use in controlling the flow in a fluid transmission conduit, such as a production tubing string, in a subterranean oil or gas well in response to changes in control fluid pressure. The valve comprises a valve housing having a bore communicating with the fluid transmission conduit. A shiftable valve closure member, such as a ball valve element or flapper valve element for opening and closing the valve bore, is employed. An actuating system which includes an axially shiftable member is employed for imparting rotation to either the ball or flapper closure member. This actuating mechanism causes the valve to rotate between the open and closed positions. In the safety valve depicted in the preferred embodiment of this invention the actuating mechanism is shiftable in response to an increase in control fluid pressure to cause a ball valve to rotate from the closed to the open position. The actuating mechanism employs a camming mechanism for imparting rotation. Although the preferred embodiment of the invention is a ball type safety valve it should be understood that the invention can similarly encompass flapper type safety valves. The actuating mechanism also employs an expandable and contractable bellows which is actuated by changes in control pressure. This bellows supports a pressure differential, which in the preferred embodiment of this invention is equal to the difference in pressure between the control fluid and the well pressure below the valve. Use of the bellows to support this pressure differential means that elastomeric seals need not be used in the control pressure actuating mechanism.

DESCRIPTION OF THE PREFERRED EMBODIMENTS

The preferred embodiment of this invention as depicted in FIGS. 1 through 6 comprises a downhole safety valve employing a ball type valve element. This specific valve is utilized with a conventional lock assembly so that the valve can be positioned within a fluid transmission conduit or tubing string. It should be understood however that the invention disclosed herein can also be employed with a valve utilizing a flapper type valve element or with a valve which can be incorporated directly into the tubing string (tubing mounted valve).

The use of a bellows assembly in the control pressure actuating mechanism is applicable to valves in general, whether safety valves or downhole control valves, and to flapper or ball type valves. As used herein a bellows is a mechanism comprising a pliable axially expandable and contractable enclosure or diaphragm actuated by differential pressure forces acting on the bellows in the axial direction. The bellows employed in the preferred embodiment of this invention comprises a tubular expandable and contractable member which has pleated or accordion like sides to permit expansion and contraction. In the preferred embodiment of this invention the bellows are metallic. The metallic bellows may be one-piece formed cylindrical bellows or may be fabricated by bonding or welding separate yieldable diaphragm elements to form a pliable pressure holding member.

Figure 1A:
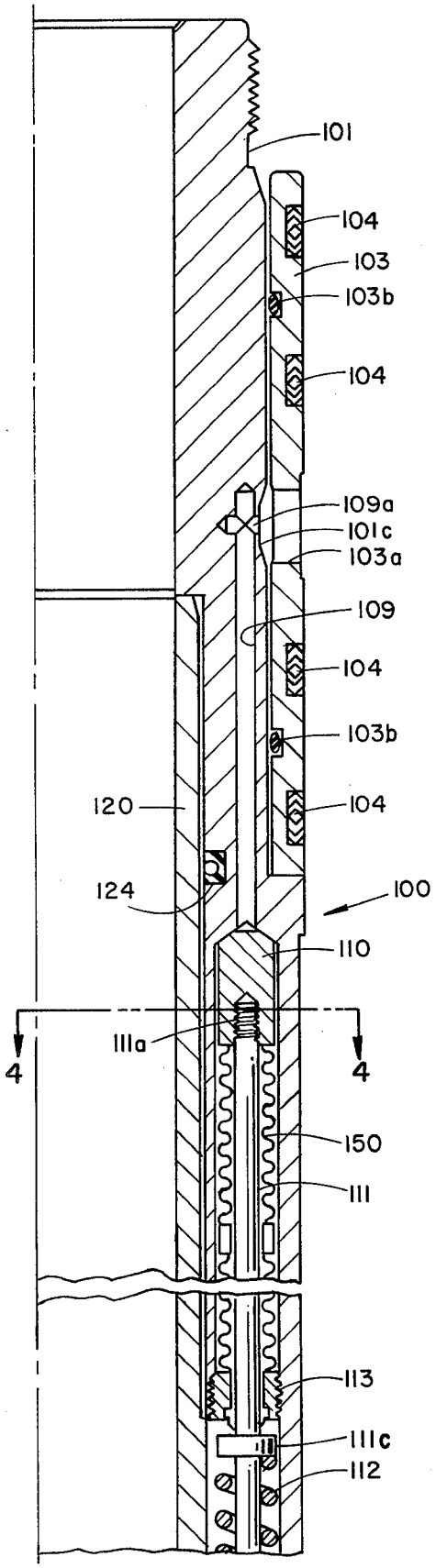
FIGS. 1A and 1B collectively constitute a vertical quarter-sectional view of a ball type valve element incorporating an actuating mechanism embodying this invention, with the ball valve
Figure 1B:
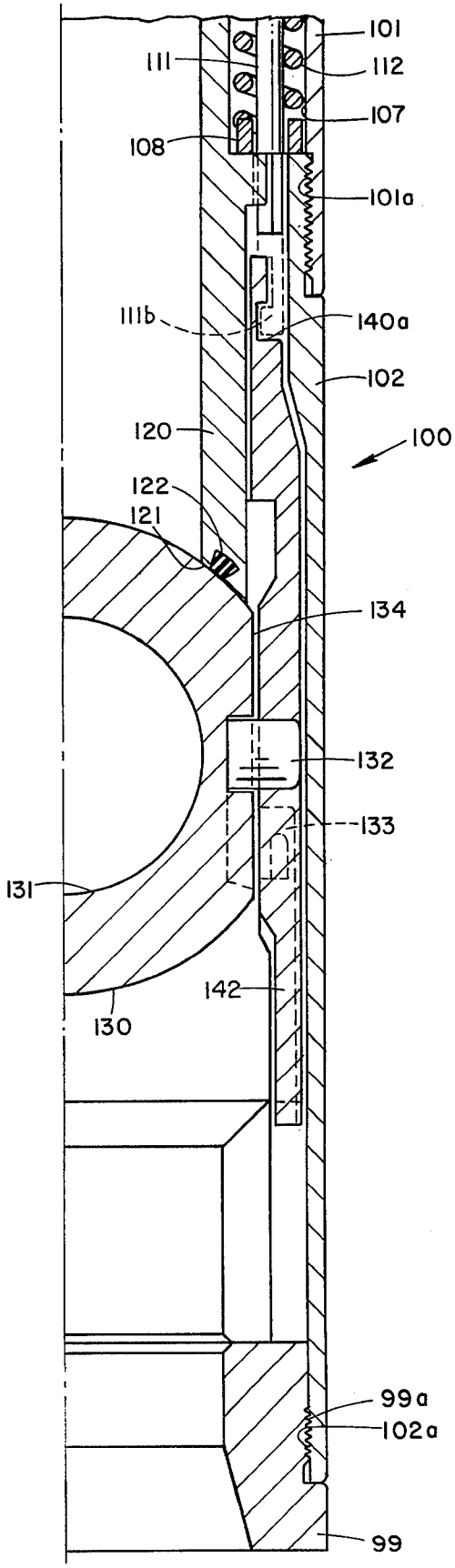

Referring now to FIGS. 1A and 1B, the numeral 100 represents a ball valve assemblage which may be positioned within a well conduit in conventional fashion. The ball valve assemblage includes a tubular upper housing 101 which is threadably secured as by threads **101*a* to a tubular lower housing 102. Surrounding the upper housing 101 is a sealing tube 103 upon which are mounted a plurality of axially spaced chevron type seals 104 for sealingly engaging the bore of the well conduit (not shown) within which the valve unit 100** is positioned.

A valve closure member, in the preferred embodiment comprising a rotatable ball valve 130 of conventional configuration is provided having a central axial bore 131 which may be positioned either in alignment with the bore of the lower housing 102 or disposed transversely to the bore of housing 102 as shown in FIG. 1B. Ball valve 130 is provided with flattened surfaces 134 on its opposite sides and a pair of ball pivot pins 132 project from the flattened surfaces 134 to provide a pivot axis for rotation of the ball. Additionally, flattened surfaces 134 are provided with recessed camming surfaces 135 (FIG. 3) which are respectively engaged by ball rotation pins 133. Ball rotation pins 133 are respectively mounted on the upper ends of two upstanding axial flanges **99*b* which project upwardly from a bottom sub 99, which is threadably secured by threads 99*a* engaging threads 102*a* provided in the bottom of the lower housing 102** (FIG. 1B and FIG. 3).

Figure 3:
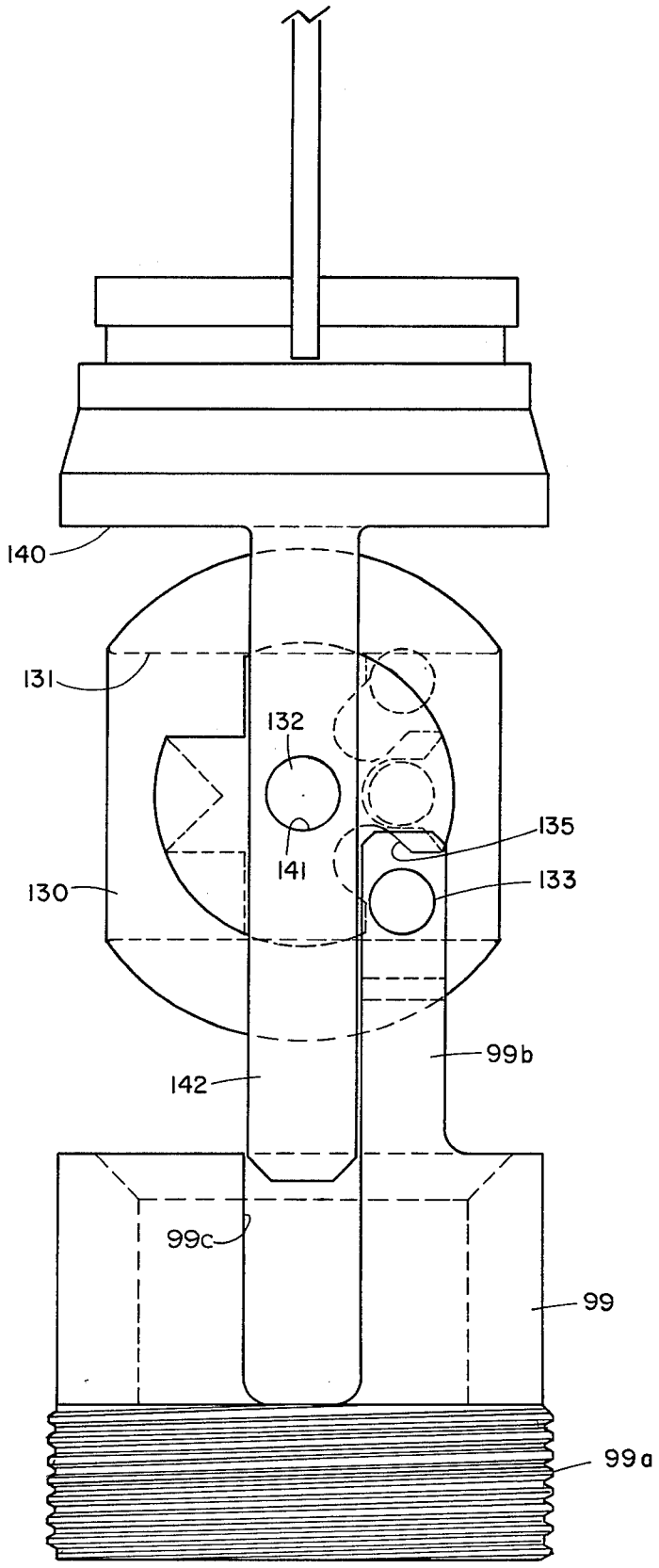

The ball 130 is supported by the pivot pins 132 respectively engaging apertures 141 provided in two depending flanges 142 formed on an annular ball actuating sleeve 140 (FIG. 3). Axial slots **99*c* are provided in the bottom sub 99 to permit downward movement of the depending axial flanges 142. From FIG. 3 it will be readily apparent that upon the occurrence of relative downward movement of the actuator sleeve 140 with respect to the bottom sub 99, the entire ball valve 130 is first moved axially downwardly, and then the ball 130 is rotated about pivot pins 132 through the interengagement of the rotation pins 133 with the upstanding cam surfaces 135 provided on ball valve 130**.

As is well known to those skilled in the art, it is desirable to provide some form of sealing mechanism to prevent fluid leakage around the exterior of the ball valve 130 when it is positioned in its closed position with respect to the bore of housing 102. Such seal is provided by a flow tube 120 which is mounted for axial sliding movement within the bores of the lower housing 102 and upper housing 101. Flow tube 120 is provided with a chamfered end surface 121 and an annular resilient seal 122 is mounted in such end surface and is normally positioned in sealing engagement with the perimeter of the ball 130. Additionally, as best shown in FIG. 1A, an annular seal 124 is provided in the interior bore surface of upper housing 101 to maintain a sealing engagement with the external periphery of flow tube 120. Thus, fluid leakage around the flow tube and around the perimeter of the ball 130 is effectively eliminated.

It is equally desirable that the annular seal 122 carried by the end of the flow tube 120 be maintained in engagement with the perimeter of the ball 130 when the ball is in its open position so as to prevent any substantial amount of fluid around the exterior of the ball which always involves the risk that particulate matter carried by the fluid can obstruct the operation of the pivot pin 132 and camming pin 133 and to minimize turbulence. Therefore, the following sequence of movement of the ball valve 130 and its actuating sleeve 140 relative to the flow tube 120 represents the desired operating condition. The ball valve 130 should be moved axially out of engagement with the annular seal 122 carried by flow tube 120 before any rotation of the ball valve 130 occurs, thus, eliminating the possibility of damage to the annular seal 122. However, when the ball valve 130 has been rotated to its fully open position, the annular seal 122 carried by the flow tube should be moved axially back into engagement with the perimeter of the ball 130. This desired sequence of movement is efficiently and economically accomplished in accordance with this invention through the provision of four fluid pressure actuators which are respectively mounted in the wall portion of the upper housing 101 in angularly spaced relationship, preferably at 90° relative to each other, with two diametrically opposed actuators being connected to the ball valve actuating sleeve 140 and the remaining two actuators being connected to the flow tube 120.

Figure 4:
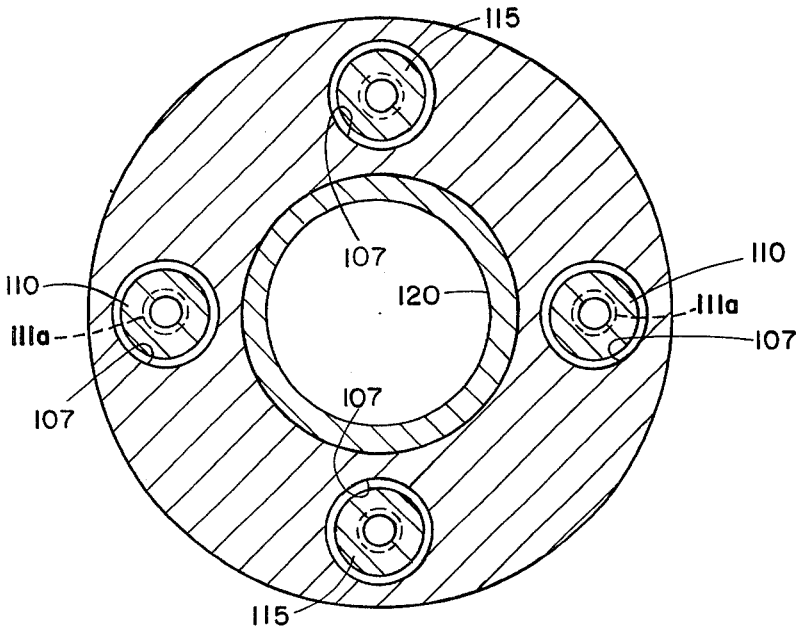

As best shown in FIG. 4, the upper housing 101 can be provided with four axially extending cylinder bores 107 which are peripherally spaced at 90° intervals and laterally offset from the valve bore. In two diametrically opposed cylinder bores 107, a pair of ball actuating pistons and bellows elements 110 are respectively mounted, and in the remaining two diametrically opposed cylinder bores 107, a pair of flow tube actuating bellows elements 115 are slidably mounted.

According to this invention, the downward ball actuating movement of the ball actuating member 140 is produced by a pair of actuating piston rods 111 which are respectively connected at their upper ends to the bellows elements 110 by threads 111*a*. Rods 111 each pass through annular anchoring blocks 113 which are threaded into the lower end of the cylinder bores 107. The bottom ends 111*b* of rods 111 are of hook shaped configuration and engage an annular recess 140*a* (FIG. 1B) provided on the ball actuating member 140. A spring 122 surrounds each actuating rod 111 and acts between a shoulder 111*c* provided on the rods and a spring seat ring 108 which abuts the upper face of the lower outer housing 102.

Figure 2:
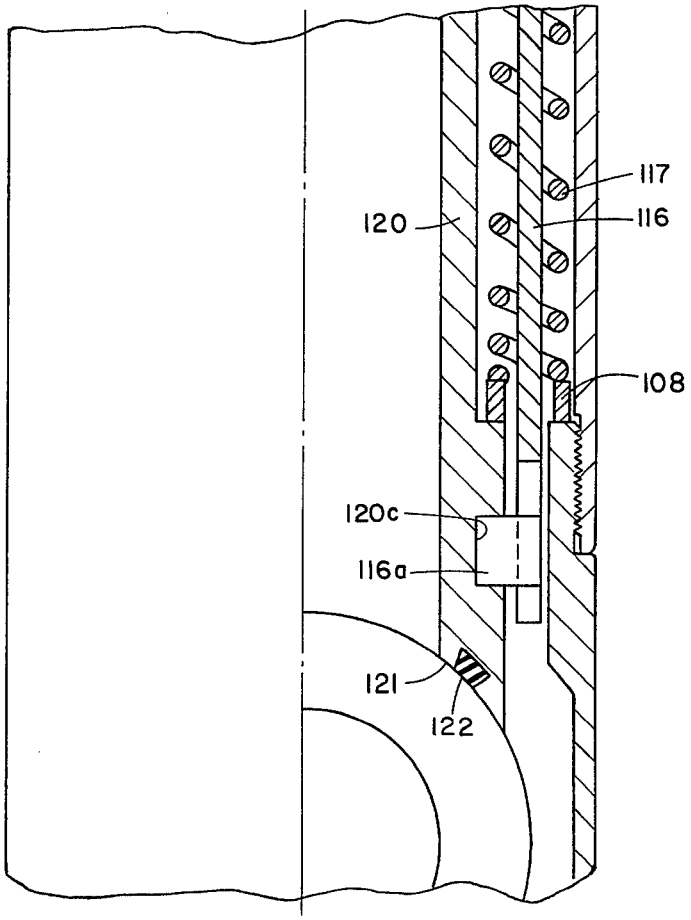

The required downward movement of the flow tube 120 is produced by a pair of rods 116 (FIG. 2) which at their upper ends engage the bellows elements 115. The rods 116 are provided with internal lugs 116*a* at their lower ends which engage a suitable groove 120*c* provided in the flow tube 120. A spring 117 surrounds the lower end of each of the acutating rods 116 and are compressed between a shoulder (not shown) carried by such rods and a spring seat ring 108 which abuts the upper face of the lower outer housing 102 (FIG. 2).

Control fluid is concurrently supplied to the upper ends of each of the cylinder bores 107 through an axial passage 109 (FIG. 1A) which communicates through a radial port 109*a* with an annular recess 101*c* provided on the exterior of the upper tubular housing 101. Recess 101*c* is disposed beneath the sealing sleeve 103 and fluid leakage along the exterior of the upper housing 101 is prevented by a pair of axially spaced O-rings 103*b* carried by the sealing sleeve 103 and respectively disposed above and below the annular recess 101*c*. A radial port 103*a* in sealing sleeve 103 permits communication with a small conduit (not shown) leading to a source of pressured control fluid in conventional manner.

It is therefore apparent that pressured control fluid is concurrently supplied to each of the cylinder bores 107 and hence, concurrently supplied to acutator pistons 110 and 115. To isolate the control fluid pressure from the well fluids, which have free access to the open bottom ends of the axially extending cylinder bores 107, it is preferred to utilize bellows elements 150. Bellows units 150 are respectively provided in surrounding relationship to each of the rods 111 and 116. Bellows units 150 are secured at their upper end by sealable attachment to the actuation piston 110 or 115, as the case may be, and at their lower ends by sealable attachment to the anchoring rings 113. This effectively eliminates the need for any elastomeric seals within the actuating mechanism for the ball valve unit and further eliminates the need for any precise sealing relationship between either of the actuating pistons 110 or 115 and the respective cylinder bores 107.

Figure 6:
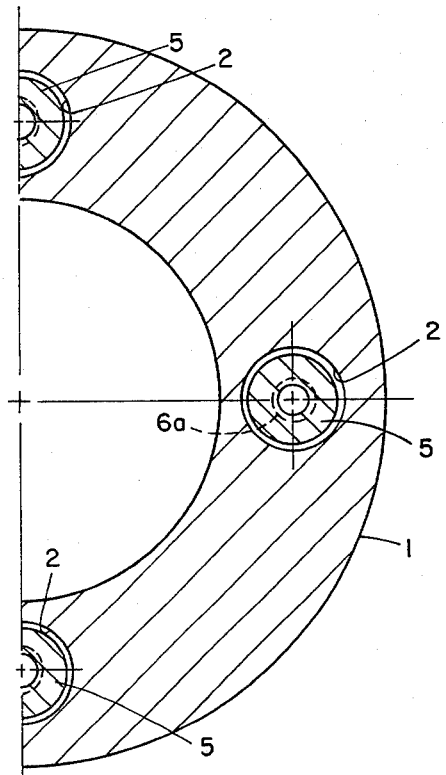
FIG. 6 is a sectional view taken along lines 6—6 in FIG. 5.
Figure 5:
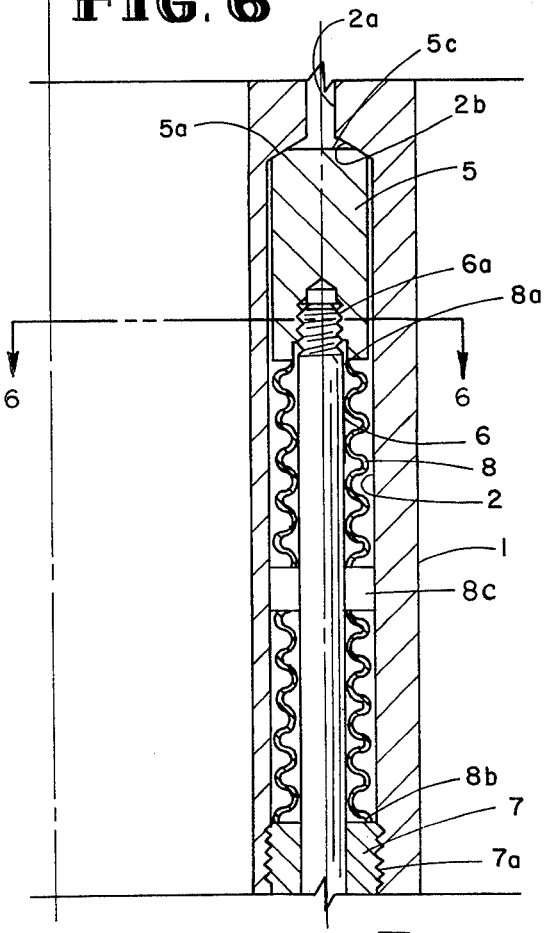
FIG. 5 is a sectional view of a bellows actuating assembly as employed in the preferred embodiment of this invention.

Referring to FIGS. 5 and 6, there is shown a simplified form of fluid pressure actuator embodying this invention which is particularly adapted for use in subterranean well valves where the ambient temperatures may be in excess of 400° F. and where contact with gases may make the use of an elastomeric seal impractical. This assembly is basically the same as shown in FIG. 1A. In FIG. 5, numeral 1 represents a tubular housing within which one or more actuators may be mounted. Housing 1 defines one or more, and generally two diametrically opposed, axially extending cylinder bores 2. The upper end portion of the bores 2 is constricted to form an inlet fluid passage 2*a* through which pressured control fluid may be admitted in a manner well known to those skilled in the art.

A plug, check valve element or piston head 5 is slidably mounted within each bore 2. No special sealing arrangements other than a reasonably close fit of the exterior of the plug 5 with the wall of bore 2 is required. Plug 5 engages the end 6*a* of an actuating piston rod 6 which extends from plug 5 and passes out through an annular anchoring insert 7 which is threadably secured in the lower end of the cylinder bore 2 by threads 7*a*. Rod 6 is connected to a valve actuating or camming mechanism (see actuator sleeve 140 in FIG. 1B).

The top end of plug 5 is provided with a chamfered surface 5*a* which cooperates with the downwardly facing, inclined annular surface 2*b* defined by the difference in diameters between the cylinder bore 2 and the inlet port 2*a*. When the piston 5 is in its uppermost position, as illustrated in FIG. 1, a metal-to-metal seal exists between chamfered surfaces 5*a* and 2*b*. This seal can be further improved by the addition of a low pressure elastomeric seal on the upper face of the plug 5.

A seal between the pressure control fluid admitted to cylinder bore 2 and well fluids is provided by an axially expandable and contractable bellows element 8 (equivalent to bellows 150 in FIG. 1A) which is freely mounted within the cylinder bore 2 and surrounds the actuating rod 6. Bellows 8 has its top end portion 8*a* secured to the bottom end of plug 5. The bottom end 8*b* of bellows unit 8 is secured to the upper surface of the anchoring insert 7. Centralizers 8*c* are sealably attached, preferrably by a welding operation, intermediate the ends of the bellows 8. These centralizers perform two functions. First the centralizers prevent the long bellows elements from buckling or warping during contraction. The centralizers also permit the use of sections of bellows of standard length. The bellows element can then be easily fabricated in different lengths. The threads 7*a* are sealably attached, thus no significant fluid leakage occurs through such attachment and it will be readily apparent that the interior of the bellows 8 is separated completely from fluids on the exterior of bellows 8 by the aforedescribed joints. In the preferred embodiment of this invention the bellows is welded to plug 5 and to insert 7 to form a fluid tight barrier supporting a pressure differential equal to the difference between control pressure above and surrounding the bellows and well pressure below and on the interior of the bellows.

A fluid actuator embodying this invention has the further advantage that the control fluid pressure has a dual action on the actuator. In the first place, it acts on the end face 5*c* of plug 5 to urge the piston downwardly. Since any deformation of the bellows unit 8 requires a resilient contraction of the corrugated walls of the bellows unit, it follows that the downward movement of the plug 5 is resiliently opposed by the compression of the bellows. For this reason, the amount of spring force normally required to oppose the downward movement of the plug 5 may be significantly reduced. Such spring (not shown) may surround the lower end of rod 6.

The migration of control fluid around the exterior of bellows 8 is significant. The interior of bellows 8 is exposed to well pressure below the valve. The presence of control fluid on the exterior of the bellows means that the fluid tight bellows need not support the absolute pressure of either the control fluid or the well fluid. The bellows must only support a smaller pressure, the difference between control pressure and well pressure. It is significant that control fluid remains in the pressure chamber surrounding bellows 8 even after plug 5 closes port 2a.

Figure 8:
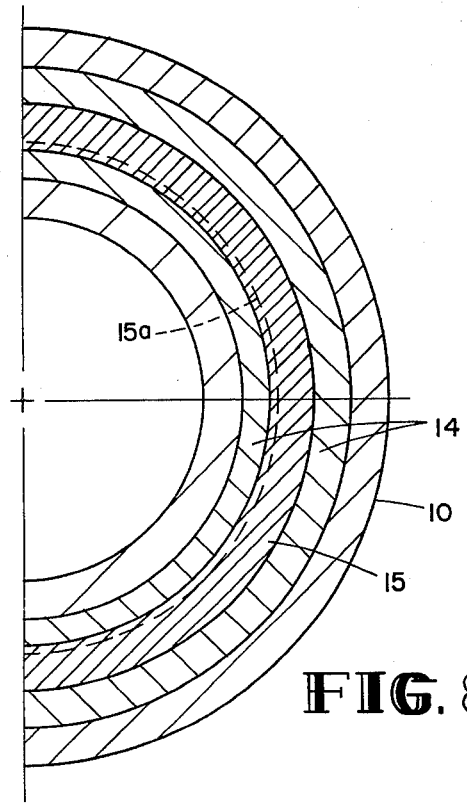
FIG. 8 is a cross-sectional view taken along section lines 8—8 in FIG. 7.
Figure 7:
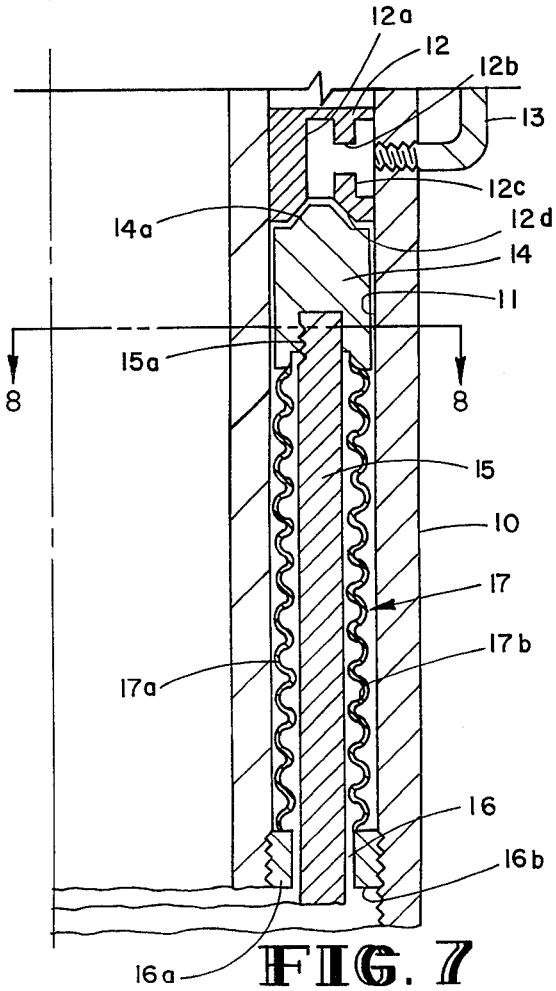
FIG. 7 is a view of an alternate embodiment of a bellows actuating mechanism in which the bellows is concentric with respect to the valve bore.

Referring now to the modification of FIGS. 7 and 8, the principles of the invention utilized in the modification of FIGS. 1 and 2 may be applied to produce a tubular actuator operated by a pressure control fluid acting on the end of an annular piston which in turn is connected to an annular bellows unit which surrounds the upper portion of the tubular actuator.

In this modification, the valve housing 10 defines an annular fluid pressure chamber or cylinder bore 11. Pressure control fluid is supplied to the upper end of the annular bore 11 through an annular ported member 12 which is welded or otherwise rigidly and sealably affixed in the top end of the cylinder bore 11. Ported member 12 defines a plurality of peripherally spaced, axial passages 12a which are connected by radial ports 12b to an external annular recess 12c. An inlet conduit 13 is provided for supplying pressured control fluid to the annular recess 12c, and thus, to the annular cylinder bore 11.

The piston 14 is of annular configuration and is mounted for axial movement within the annular cylinder bore 11. The top end face 14a of annular piston 14 may be chamfered to provide a sealing engagement with the similarly chamfered bottom surfaces 12d of the annular flow plug 12.

The actuating rod for the annular piston 14 comprises a tube 15 which is engaged by threads 15a in the bottom portion of piston 14. Actuator tube 15 extends downwardly out of the annular cylinder bore 11 to engage a valve actuating mechanism (not shown), passing through an annular passage 16 defined by an internal anchor ring 16a which is threaded to the inner wall of the annular cylinder bore 11 and an outer anchor ring 16b which is threadably engaged with the other wall of the annular cylinder bore 11.

The required seal to isolate the pressured control fluid from any well fluids is provided by a bellows 17 which is of annular configuration having concentric inner and outer walls 17a and 17b. Each of the walls 17a and 17b is provided with the conventional corrugated configuration in a vertical radial plane so that the application of a downward force to the annular bellows 17 by the piston 14 will effect a contraction of the bellows. As in the other embodiment, bellows 17 will support a pressure differential equal to the difference between control pressure and well pressure.

It is therefore apparent that the described bellows arrangement will permit the utilization of either a cylindrical type actuator or a tubular actuator in a hostile downhole environment and will effect the isolation of the pressured control fluid from any well fluids through the barrier imposed by the bellows unit and its welded connections to the piston and to the anchor members in the cylinder bore.

The use of a bellows to provide a seal between control fluid and well fluid permits the elimination of elastomeric O-ring or rod seals used in conventional valves. The elimination of elastomeric seals is important where the valve must operate under hostile temperature and environmental conditions. The use of a fluid tight metallic bellows also means that control fluid need not be liquids. Gas can be employed as the control fluid because gas will not leak past the metallic bellows in the same manner as it would pass through an elastomeric seal. The bellows actuating mechanism also lends itself to use in a deep-set safety valve because the effective control pressure area is less than the area of a sleeve type piston in a conventional safety valve.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve for use in controlling the flow through a fluid transmission conduit in a subterranean oil or gas well in response to changes in a control pressure, comprising:

a valve housing having a bore communicating with the fluid transmission conduit;

a shiftable valve closure member for opening and closing the valve bore;

actuating means for shifting the valve closure member between open and closed positions in response to differential changes in a supplied control fluid pressure and the well fluid pressure below said valve closure member comprising an expandable and contractable bellows exposed to said control pressure on one surface, said bellows supporting said pressure differential thereacross; and means for supplying said control pressure to said bellows to shift said actuating means in response to differential pressure changes acting on said bellows.

2. The valve of claim 1 wherein said actuating means further comprises a piston engagable with the valve closure member to shift the valve closure member between open and closed positions, one end of the piston, spaced from the valve closure member being contained within the bellows, the piston being shiftable in conjuction with expansion and contraction of the bellows.

3. The valve of claim 2 wherein the exterior of said bellows is exposed to control pressure and the interior of said bellows is exposed to the pressure in the well.

4. The valve of claim 3 wherein the piston is axially shiftable and the bellows is axially expandable and contractable.

5. The valve of claim 4 wherein the axis of piston and bellows is laterally offset from the axis of the valve bore.

6. The valve of claim 4 wherein the piston comprises an annular member concentric with the valve bore, the bellows comprising inner and outer annular corrugated members encompassing the one end of the piston.

7. The valve of claims 1, 2, 3, 4, 5, or 6 wherein one end of the bellows is sealably attached to the valve housing and the other end of the bellows is sealably attached to a piston head member, said piston head member being engagable with one end of the piston.

8. Apparatus for actuating a flow control device in a subterranean well in response to changes in control pressure, comprising:

an apparatus housing;

a shiftable flow control member;

a pressure chamber defined within the apparatus housing;

an actuating member extending into the pressure chamber and engagable with the flow control member;

means including a port communicating with the pressure chamber for supplying control pressure to the pressure chamber;

plug means in the presence chamber for opening and closing said port, the actuating member being engagable with the plug means;

an expandable and contractable bellows in the pressure chamber, with said supplied control pressure acting on the one surface of the bellows, the well pressure acting on the actuating member acting on the other surface of the bellows; and a sealable attachment between one end of the bellows and the apparatus housing, the bellows supporting a pressure differential whereby an increase in said control fluid pressure imparts movement to the remainder of the said bellows relative to the sealable attachment, and movement of the actuating member to shift the flow control member.

9. The apparatus of claim 8 wherein the one bellows surface exposed to control pressure is the exterior and the other bellows surface is the interior.

10. The apparatus of claim 8 or 9 wherein said control pressure comprises the pressure of a gas in the pressure chamber.

11. A safety valve for use in controlling the flow through a fluid transmission conduit in a subterranean oil or gas well in response to changes in control pressure, comprising:

a valve housing having a bore communicating with the fluid transmission conduit;

a shiftable valve closure member for opening and closing the valve bore;

an axially extending pressure chamber defined within the valve housing;

means including a port communicating with one end of the pressure chamber for supplying control pressure to the chamber;

plug means in the pressure chamber for opening and closing the port;

an axially shiftable actuating member engagable with the plug means and with the valve closure member, the valve closure member moving between open and closed positions in response to axial movement of the actuating member; and an axially expandable and contractable bellows in the pressure chamber, one bellows end being sealably attached to the plug member and the other bellows end being sealably attached to the valve housing so that the bellows supports a pressure differential thereacross; whereby said control pressure changes shift the plug and actuating member to shift the valve closure member, said supplied control pressure in the pressure chamber acting only on the exterior of the bellows.

12. The safety valve of claim 11 wherein the interior of the bellows is exposed to the pressure in the well.

13. The safety valve of claim 12 wherein the axis of the pressure chamber is laterally offset with the axis of the valve bore.

14. The safety valve of claim 12 wherein the actuating member comprises an annular member concentric with the valve bore, the bellows comprising inner and outer annular corrugated members encompassing one end of the actuating member.

15. The safety valve of claim 11, 12, 13 or 14 wherein the one bellows end is welded to the plug means and the other bellows end is welded to the valve housing.

16. A safety valve for use in controlling the flow through a fluid transmission conduit in a subterranean oil or gas well in response to changes in a supplied control pressure, comprising:

a valve housing;

a valve closure member;

a pressure chamber exposed to said control pressure on one end and to well pressure on the other end;

an expandable and contractable axially extending bellows in the pressure chamber, sealably isolating the chamber end exposed to said supplied control pressure from the chamber and exposed to well pressure, said supplied control pressure acting on one axially extending surface of the bellows and said well pressure acting on the opposite axially extending surface of the bellows, so that the pressure differential acting on the bellows is less than the absoluted supplied control pressure or the absolute well pressure; and an actuating member for shifting the valve closure member upon axial movement produced by expansion and contraction of the bellows in response to changes in said supplied control pressure.

* * * * *